United States Patent [19]

Leone et al.

[11] Patent Number: 4,866,225

[45] Date of Patent: Sep. 12, 1989

[54] INSULATED LIGHT WEIGHT METALLIC CROSSBAR IN POLYPHASE CIRCUIT BREAKER ASSEMBLIES FOR INHIBITING ARCING

[75] Inventors: David A. Leone; Clifford A. Buxton, both of Lawrenceville, Ga.

[73] Assignee: Siemens Energy & Automation, Inc., Atlanta, Ga.

[21] Appl. No.: 242,091

[22] Filed: Sep. 8, 1988

[51] Int. Cl.[4] ..... H01H 9/30

[52] U.S. Cl. ..... 200/144 R; 200/50 C; 335/8

[58] Field of Search ..... 200/17 R, 50 C, 144 R; 335/8, 9, 10, 16, 22, 41, 42, 201

[56] References Cited

U.S. PATENT DOCUMENTS

| | | | |
|---|---|---|---|
| 3,073,927 | 1/1963 | Hill et al. | 335/10 |
| 3,422,381 | 1/1969 | Toth | 335/9 |
| 3,946,346 | 3/1976 | Oster et al. | 335/16 |
| 4,137,437 | 1/1979 | Maier et al. | 200/153 SC |
| 4,227,161 | 10/1980 | Yamat et al. | 335/16 |
| 4,524,339 | 6/1985 | Chabot | 335/22 |
| 4,580,021 | 4/1986 | Fujikake | 200/153 G |
| 4,642,431 | 2/1987 | Tedesco et al. | 335/16 X |

FOREIGN PATENT DOCUMENTS

| | | |
|---|---|---|
| 1154553 | 9/1963 | Fed. Rep. of Germany . |

*Primary Examiner*—J. R. Scott

*Attorney, Agent, or Firm*—James G. Morrow

[57] ABSTRACT

A crossbar spanning the poles of a multiple pole circuit breaker. The crossbar is formed from a structural member such as beam having an I-shaped cross-section, wherein an insulating material such as plastic is molded to the beam. The shape of the structural member is such that it provides a high strength to weight ratio. The plastic is molded such that it includes means for inhibiting arcing between the poles of the circuit breaker.

11 Claims, 2 Drawing Sheets

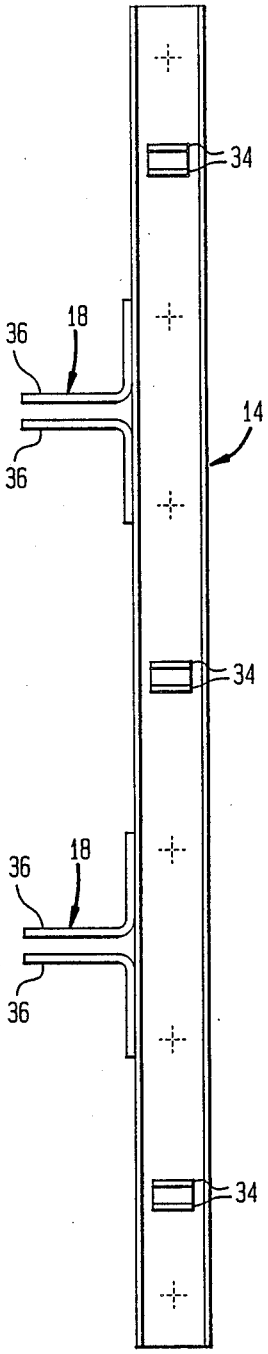
FIG. 4
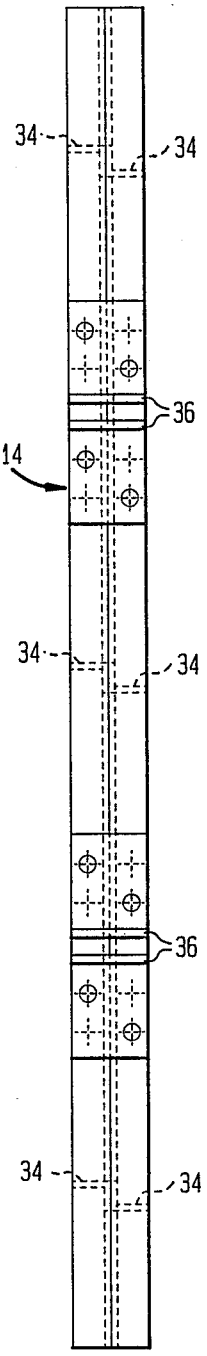
FIG. 5
FIG. 3
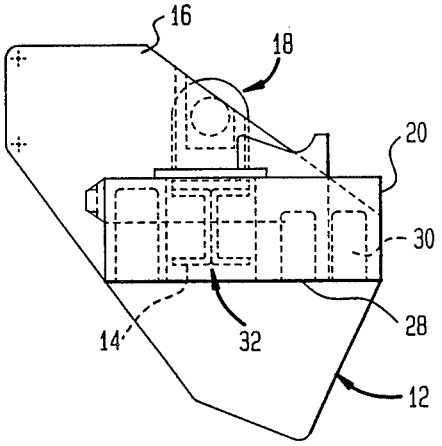
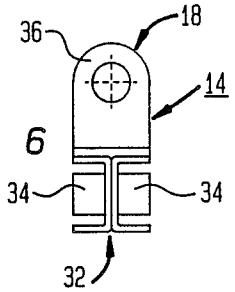
FIG. 6
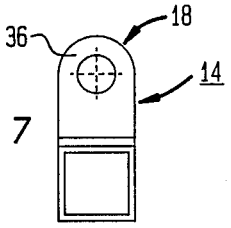
FIG. 7

INSULATED LIGHT WEIGHT METALLIC CROSSBAR IN POLYPHASE CIRCUIT BREAKER ASSEMBLIES FOR INHIBITING ARCING

BACKGROUND OF INVENTION

This invention relates to the main contact blade assembly for a switching device, and more particularly, to a structural member for transferring a closing force to the contact blade assembly of a circuit breaker.

U.S. Pat. Nos. 4,580,021, 4,524,339 and 4,137,437 illustrate various forms of crossbars (cross arms). In FIGS. 1–5 and 9 of U.S. Pat. No. 4,580,021 a crossbar 36 is illustrated. The crossbar 36 is coupled to a toggle mechanism 60 and intercouples the three poles of the circuit breaker through insulating holders 38. The crossbar is illustrated as having a solid semicircular shaped cross-section. In FIGS. 3*a* and 5*b* of U.S. Pat. No. 4,524,339 a square crossbar 46 is illustrated. The crossbar 46 interconnects the blade assemblies 20 and is secured to the top surface of each blade carriers 22. In FIGS. 1, 10 and 13 of U.S. Pat. No. 4,137,437 a cross arm 68 which extends between the individual crossbar and spring holders 64 is illustrated. The cross arm 68 assures that each of the three poles illustrated will move simultaneously upon movement of the operating mechanism 32 to drive the contacts 26, 28 into the closed or open position.

Due to the nature and purpose of a circuit breaker, it is important that the contacts of a circuit breaker are separated as fast as possible when circuit interruption is required. Additionally, it is also important that the contacts of a circuit breaker are closed as uniformly as possible so that the distribution of current flowing through the contacts is substantially uniform. Furthermore, the weight of the crossbar should be such that when the contacts are closed the contacts are not damaged due to the impact force generated at the contacts upon closing. Also, a reduction in the cross bar weight effects a reduced impact energy imparted to the circuit breaker upon opening. Accordingly, it is important that a crossbar be as rigid as possible while also being as light as possible.

Another consideration in providing a crossbar is to ensure that the crossbar is insulated in such a way that arcing is prevented between the poles of a circuit breaker. One way of insulating a crossbar is to coat the crossbar with an insulating material. A problem which arises when coating metallic crossbars with an insulating material is insuring adhesion between the coating and the crossbar.

SUMMARY OF THE INVENTION

An object of the present invention is to provide a lightweight crossbar which is structured to be rigid enough to provide for a substantially uniform closing of the contacts in a circuit breaker.

Accordingly, there is provided a crossbar adapted to be coupled to a plurality of circuit breaker contact blades of a multiple pole circuit breaker. The crossbar comprises a beam having a substantially thin-walled cross-section; means for coupling a contact moving mechanism to the crossbar; and an insulating material formed onto the beam including at least one insulating divider means adapted to inhibit arcing between the poles.

An advantage of the present invention is that it provides a lightweight and rigid crossbar which is cost effective to manufacture.

Various other objects and advantages of the present invention will become apparent from the following description, with reference to the accompanying drawing.

BRIEF DESCRIPTION OF THE DRAWINGS

FIG. 3 is an end view of the crossbar;

FIG. 4 is a side view of the preferred embodiment of the crossbar beam;

FIG. 5 is a top view of the crossbar beam;

FIG. 6 is a side view of the crossbar beam;

FIG. 7 is a side view of a crossbar having a rectangular cross section.

DETAILED DESCRIPTION OF THE PREFERRED EMBODIMENT

Figure 1:
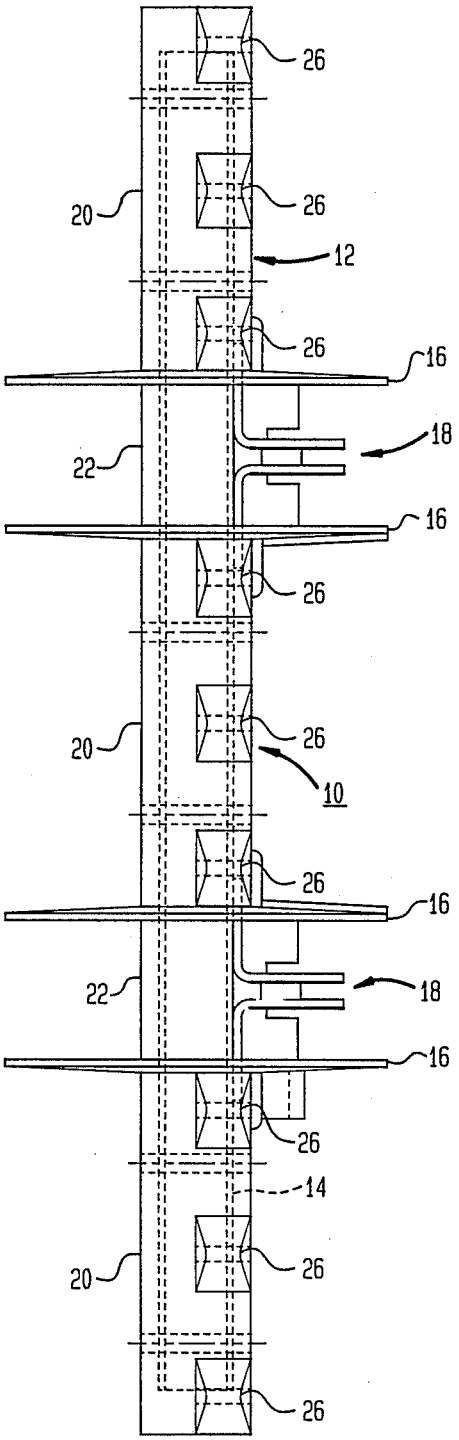
FIG. 1 is a side view of the preferred embodiment of the crossbar.
Figure 2:
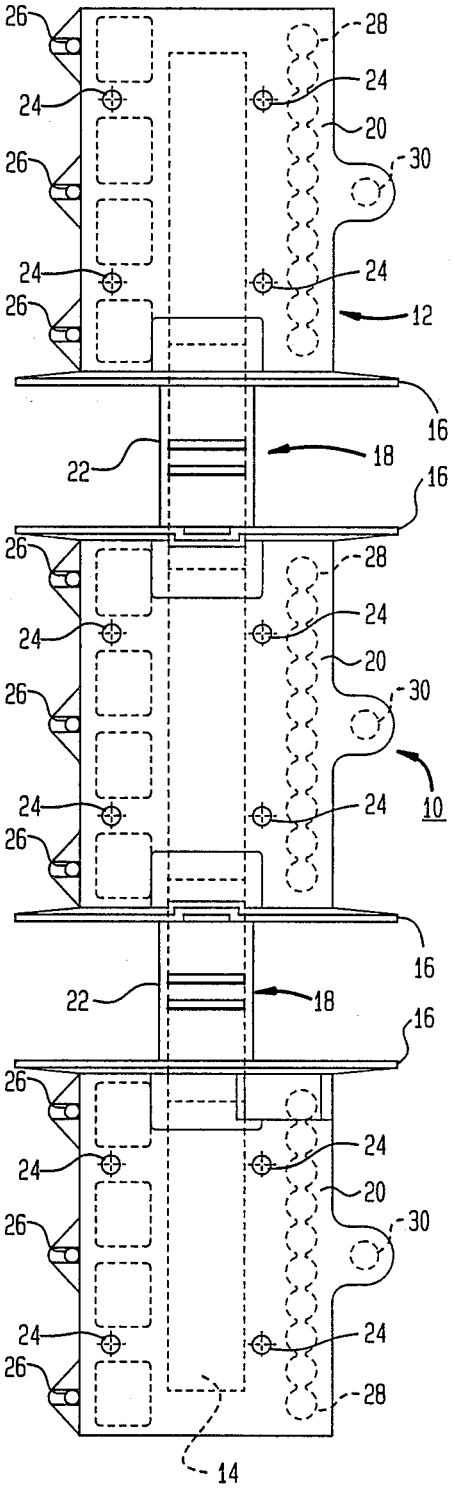
FIG. 2 is a top view of the crossbar.

Referring to the drawings, FIGS. 1, 2 and 3 illustrate the preferred embodiment of the crossbar 10 for use in a three pole molded case circuit breaker. The crossbar 10 includes a molded portion 12 and a crossbar beam 14.

The molded portion 12 includes four insulating barriers 16 which aid in insulating the linkage connections 18 and their associated linkages (not shown) from the contact blade assemblies (not shown). The molded portion 12 also includes three contact blade mounting portions 20 and two cross bar beam insulating portions 22 which insulate the crossbar beam 14 between the insulating barriers 16.

The mounting portions 20 each include contact blade assembly mounting holes 24, tension spring mounting holes 26 and compression spring openings 28, 30. The mounting holes 24 provide a means for attaching the contact carrier of the contact blade assemblies to the crossbar 10. The compression spring mounting holes 28 are provided to contain compression springs (not shown) for applying a closing force to the primary contacts of the contact blade assemblies. The compression spring mounting holes 30 are provided to contain compression springs (not shown) for applying a closing force to the secondary contacts of the contact blade assemblies.

The compression springs function to provide a substantially even distribution of force between the contacts of the contact blade assemblies. To facilitate this distribution of force, the contact carrier is attached to the crossbar 10 such that the crossbar 10 has a limited movement relative to the contact carrier to allow the compression springs to be compressed upon contact closing.

The tension spring mounting holes 24 are provided for the attachment of tension springs (not shown) which urge the crossbar 10 in a direction such that the crossbar 10 opens the contacts of the contact blade assemblies.

Referring now to FIGS. 4, 5 and 6, the crossbar beam 14 is shown in more detail. The beam 14 includes two linkage connections 18, a substantially I-shaped beam member 32 and molding tabs 34. The linkage connections 18 each include two tabs 36 mounted to the beam member 32. The tabs 36 each include an opening for a pin which serves to attach the crossbar 10 to the closing force producing mechanism or toggle mechanism of a circuit breaker (not shown). The I-shaped beam member 32 is fabricated by fastening two U-shaped members together.

Turning now to the molding tabs 34, these tabs 34 serve to maintain integrity between the beam member 32 and the molded portion 12 after the molded portion has been molded about the beam member 32. The tabs 34 allow the molded portion 12 and the beam member 32 to interact such that they each function to maintain the rigidity and force transferring ability of the crossbar 10.

While one embodiment of a crossbar has been shown and described in detail herein, various other changes and modifications may be made without departing from the scope of the present invention. For example, the crossbar could be fabricated with a different tab or opening arrangement for maintaining the integrity between the beam member and the molded portion, and the crossbar could be fabricated with a rectangular cross section.

We claim:

1. A crossbar for coupling to a plurality of circuit breaker contact blades of a multiple pole circuit breaker, wherein the circuit breaker is of the type including a contact movement mechanism, and at least one contact blade is electrically coupled to one of the poles of the circuit breaker, the crossbar comprising:

a beam having a substantially thin-walled cross section along the entire length of the beam;

means for mechanically coupling the contact movement mechanism to the crossbar, wherein the means for mechanically coupling is coupled to the beam; and an insulating material formed onto the beam including at least one insulating divider means for separating the contact blades of adjacent poles such that arcing between the poles is inhibited.

2. The apparatus of claim 1, wherein the beam comprises means for engaging the insulating material formed onto to the beam.

3. The apparatus of claim 2, wherein the crossbar further comprises means for coupling the crossbar to the circuit breaker contact blades such that the divider means separates the contact blades coupled to adjacent poles.

4. The apparatus of claim 3, wherein the cross section of the beam has a substantially I-shape.

5. The apparatus of claim 3, wherein the cross section of the beam has a substantially U-shape.

6. The apparatus of claim 3, wherein the cross section of the beam has a substantially rectangular shape.

7. The apparatus of claim 4, wherein the means for engaging the insulating material includes openings in the beam.

8. A lightweight member for coupling to a plurality of circuit breaker contact blades of a multiple pole circuit breaker, wherein the circuit breaker is of the type including a contact movement mechanism, and at least one contact blade is electrically coupled to one of the poles of the circuit breaker, the lightweight member comprising:

a beam including means for engaging, wherein the beam has a thin-walled cross section along its entire length including a plurality of legs;

means for mechanically coupling the contact movement mechanism to the crossbar, wherein the means for mechanically coupling is coupled to the beam;

an insulating material formed onto the beam such that the material engages the means for engaging, the insulating material including at least one insulating divider means for separating the contact blades of adjacent poles such that arcing between the poles is inhibited; and means for coupling the crossbar to the circuit breaker contact blades such that the divider means separates the contact blades coupled to adjacent poles.

9. The apparatus of claim 8, wherein the cross section of the beam has a substantially I-shape.

10. The apparatus of claim 8, wherein the cross section of the beam has a substantially U-shape.

11. The apparatus of claim 8, wherein the cross section of the beam has a substantially rectangular shape.

* * * * *